US009806447B2

(12) United States Patent
Kimura et al.

(10) Patent No.: US 9,806,447 B2
(45) Date of Patent: Oct. 31, 2017

(54) CONNECTOR HAVING FIXED PORTIONS OF A SHELL, DIFFERENTIAL PAIR OF SIGNAL CONTACTS AND A GROUND CONTACT ARRANGED IN A ROW FORMING A FIXED PORTION GROUP

(71) Applicant: JAPAN AVIATION ELECTRONICS INDUSTRY, LIMITED, Shibuya-ku, Tokyo (JP)

(72) Inventors: Akinori Kimura, Tokyo (JP); Takashi Tokunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/152,758

(22) Filed: May 12, 2016

(65) Prior Publication Data

US 2017/0018867 A1 Jan. 19, 2017

(30) Foreign Application Priority Data

Jul. 13, 2015 (JP) ..... 2015-139827

(51) Int. Cl.
*H01R 12/00* (2006.01)
*H01R 12/71* (2011.01)
(Continued)

(52) U.S. Cl.
CPC ..... *H01R 12/712* (2013.01); *H01R 13/6471* (2013.01); *H01R 13/6474* (2013.01);
(Continued)

(58) Field of Classification Search
CPC .. H01R 9/091; H01R 13/648; H01R 13/6164; H01R 13/65802; H01R 13/6471;
(Continued)

(56) References Cited

U.S. PATENT DOCUMENTS 6,059,581 A * 5/2000 Wu ..... H01R 13/436 439/607.27
6,099,351 A * 8/2000 Wu ..... H01R 12/725 439/541.5
(Continued)

FOREIGN PATENT DOCUMENTS

JP 2010257926 A 11/2010
JP 2011009151 A 1/2011
(Continued)

OTHER PUBLICATIONS

Extended European Search Report dated Oct. 13, 2016, issued in counterpart European Application No. 16173731.7.
(Continued)

*Primary Examiner* — Chandrika Prasad
(74) *Attorney, Agent, or Firm* — Holtz, Holtz & Volek PC

(57) ABSTRACT

A connector comprises a shell fixed portion connected to a shell, a ground contact and a differential pair consisting of two signal contacts. The ground contact has a ground fixed portion. Each signal contact has a signal fixed portion. The shell fixed portion, the signal fixed portions and the ground fixed portion are fixed to the circuit board when the connector is used. The shell fixed portion, one of the signal fixed portions, a remaining one of the signal fixed portions, the ground fixed portion form a fixed-portion group in which they are adjacent to one another in this order. Moreover, the ground fixed portion and the signal fixed portions are arranged in a row along a pitch direction. When the fixed-portion group is seen along the pitch direction, at least a part of the shell fixed portion occupies an area same as a part of the signal fixed portion.

9 Claims, 8 Drawing Sheets

(51) Int. Cl.

| | |
|---|---|
| ***H01R 13/6471*** | (2011.01) |
| ***H01R 13/6474*** | (2011.01) |
| ***H01R 13/6594*** | (2011.01) |
| ***H01R 13/6581*** | (2011.01) |
| ***H01R 24/64*** | (2011.01) |
| *H01R 24/62* | (2011.01) |
| *H01R 107/00* | (2006.01) |

(52) U.S. Cl.
CPC ..... *H01R 13/6581* (2013.01); *H01R 13/6594* (2013.01); *H01R 24/64* (2013.01); *H01R 24/62* (2013.01); *H01R 2107/00* (2013.01)

(58) Field of Classification Search
CPC ..... H01R 13/6474; H01R 13/6594; H01R 13/6461; H01R 13/65902; H01R 13/6581; H01R 12/712; H01R 24/64
USPC ..... 439/78, 676, 607.01, 607.07, 607.09
See application file for complete search history.

(56) References Cited

U.S. PATENT DOCUMENTS

| | | | | |
|---|---|---|---|---|
| 6,135,816 | A * | 10/2000 | Mashiyama | H01R 23/6873 439/607.01 |
| 6,280,209 | B1 * | 8/2001 | Bassler | H01R 12/724 439/101 |
| 6,350,134 | B1 * | 2/2002 | Fogg | H05K 1/0219 439/79 |
| 6,953,351 | B2 * | 10/2005 | Fromm | H01R 13/514 439/101 |
| 7,806,735 | B1 * | 10/2010 | Chen | H01R 13/65802 439/676 |
| 8,342,863 | B2 | 1/2013 | Kondo et al. | |
| 8,376,783 | B2 * | 2/2013 | Kondo | H01R 12/712 439/660 |
| 2004/0058572 | A1 | 3/2004 | Fromm et al. | |
| 2006/0030220 | A1 * | 2/2006 | Belopolsky | H01R 27/02 439/676 |
| 2006/0084301 | A1 | 4/2006 | Fromm et al. | |
| 2009/0253297 | A1 * | 10/2009 | Kamata | H01R 13/6275 439/607.35 |
| 2009/0305551 | A1 * | 12/2009 | Kameda | H01R 9/034 439/497 |
| 2011/0318963 | A1 * | 12/2011 | Kamoya | H01R 12/79 439/607.35 |
| 2013/0244494 | A1 | 9/2013 | Tziviskos et al. | |
| 2015/0171562 | A1 | 6/2015 | Gao et al. | |
| 2016/0254619 | A1 * | 9/2016 | Toda | H01R 12/585 439/607.01 |

FOREIGN PATENT DOCUMENTS

| | | | |
|---|---|---|---|
| JP | 2011216215 | A | 10/2011 |
| JP | 2014175248 | A | 9/2014 |
| WO | 03012928 | A1 | 2/2003 |
| WO | 03026078 | A1 | 3/2003 |
| WO | 04001907 | A1 | 12/2003 |
| WO | 2015073974 | A2 | 5/2015 |

OTHER PUBLICATIONS

European Office Action dated Aug. 16, 2017 issued in counterpart European Application No. 16173731.7.

* cited by examiner

CONNECTOR HAVING FIXED PORTIONS OF A SHELL, DIFFERENTIAL PAIR OF SIGNAL CONTACTS AND A GROUND CONTACT ARRANGED IN A ROW FORMING A FIXED PORTION GROUP

CROSS REFERENCE TO RELATED APPLICATIONS

An applicant claims priority under 35 U.S.C. §119 of Japanese Patent Application No. JP2015-139827 filed Jul. 13, 2015.

BACKGROUND OF THE INVENTION

This invention relates to a connector comprising a differential pair of signal contacts for high-speed signal transmission.

For example, this type of connector is disclosed in JP A 2010-257926 (Patent Document 1), the content of which is incorporated herein by reference.

Referring to FIG. 16, Patent Document 1 discloses a connector 900 compliant with Universal Serial Bus (USB) 3.0 standard. The connector 900 comprises five terminals (contacts) 910 for USB 3.0 connection. The contacts 910 include one ground terminal (ground contact) 910G and two differential pairs 910P for high-speed signal transmission. Each of the differential pairs 910P consists of two signal terminals (signal contacts) 910S. The ground contact 910G is located between the two differential pairs 910P in a pitch direction (Y-direction) so as to prevent cross-talk between the differential pairs 910P.

Referring to FIG. 16, the signal contacts 910S of the existing connector 900 disclosed in Patent Document 1 sometimes show degraded transmission performance.

SUMMARY OF THE INVENTION

It is therefore an object of the present invention to provide a connector comprising a differential pair of signal contacts for high-speed signal transmission and having a new structure which prevents the transmission performance of the signal contacts from being degraded.

An aspect of the present invention provides a connector mountable on a circuit board in an up-down direction. The connector comprises a shell, one or more of shell fixed portions, one or more of ground contacts and one or more of differential pairs. Each of the shell fixed portions is connected to the shell and is to be fixed to the circuit board. Each of the ground contacts has a ground fixed portion which is to be fixed to the circuit board. Each of the differential pairs consists of two signal contacts. Each of the signal contacts has a signal fixed portion which is to be fixed to the circuit board. The shell fixed portions, the ground fixed portions and the signal fixed portions form one or more of fixed-portion groups. Each of the fixed-portion groups consists of one of the shell fixed portions, one of the ground fixed portions and the two signal fixed portions of one of the differential pairs. In each of the fixed-portion groups, the shell fixed portion is adjacent to one of the signal fixed portions, the one of the signal fixed portions is adjacent to a remaining one of the signal fixed portions, the remaining one of the signal fixed portions is adjacent to the ground fixed portion, and the ground fixed portion and the signal fixed portions are arranged in a row along a pitch direction perpendicular to the up-down direction. When each of the fixed-portion groups is seen along the pitch direction, at least a part of the shell fixed portion occupies an area same as a part of the signal fixed portion.

Another aspect of the present invention provides a connector assembly comprising the connector and a circuit board on which the connector is mountable. The circuit board is formed with fixing portions to which the shell fixed portions, the ground fixed portions and the signal fixed portions are to be fixed, respectively. The fixing portions have sizes same as one another in a direction perpendicular to both the pitch direction and the up-down direction.

Still another aspect of the present invention provides a connector mountable on a circuit board. The connector comprises a shell, two shell fixed portions each of which is to be to the circuit board and N+2 of contacts where N is an integer of 1 or more. Each of the shell fixed portions is connected to the shell. Each of the contacts has a fixed portion which is to be to the circuit board. The two shell fixed portions and the N+2 fixed portions are adjacent to one another in a pitch direction to form one fixed-portion group. In the fixed-portion group, the fixed portions are arranged in a row along the pitch direction, and the shell fixed portions are located at opposite ends of the fixed-portion group in the pitch direction, respectively. When the fixed-portion group is seen along the pitch direction, at least a part of each of the shell fixed portions occupies an area same as a part of the fixed portion.

According to an aspect of the present invention, in the pitch direction, the one of the signal fixed portions of the differential pair (the outside fixed portion) is adjacent to the shell fixed portion which is to be grounded, and the remaining one of the signal fixed portions of the differential pair (the inside fixed portion) is adjacent to the ground fixed portion which is to be grounded. When seen along the pitch direction, at least a part of the shell fixed portion occupies an area same as a part of the outside fixed portion. Moreover, the ground fixed portion and the inside fixed portion are arranged in a row along the pitch direction. The aforementioned structure enables a differential impedance between the outside fixed portion and the shell fixed portion to be balanced with another differential impedance between the inside fixed portion and the ground fixed portion. As a result, transmission performance of the signal contacts can be prevented from being degraded.

An appreciation of the objectives of the present invention and a more complete understanding of its structure may be had by studying the following description of the preferred embodiment and by referring to the accompanying drawings.

Figure 1:
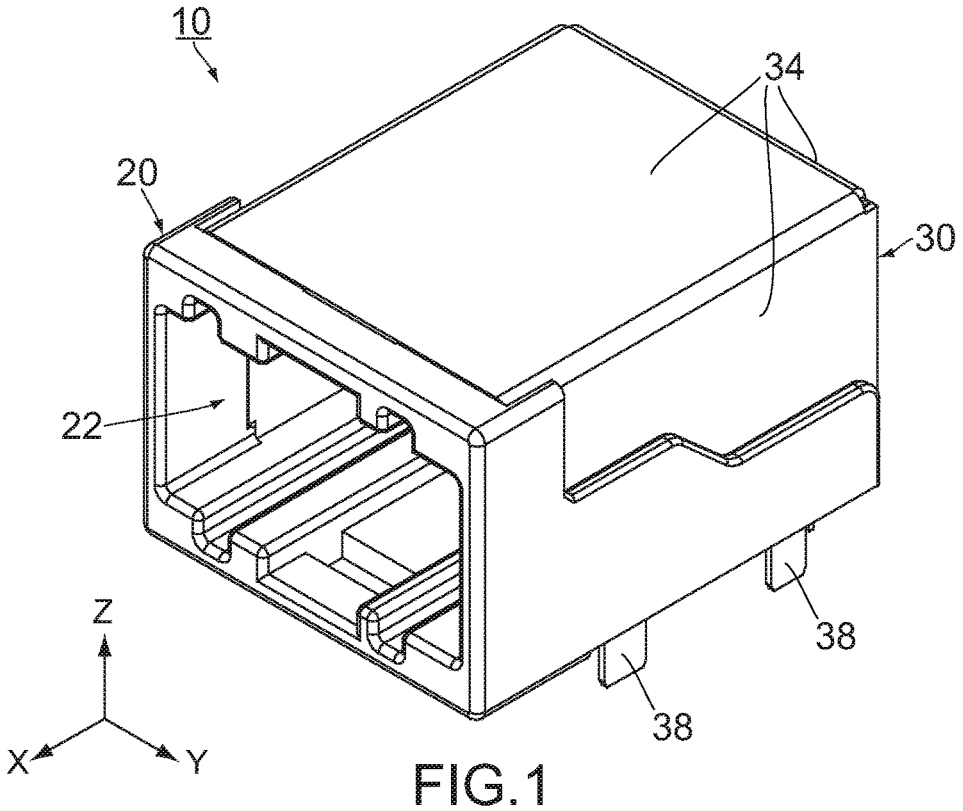
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 9:
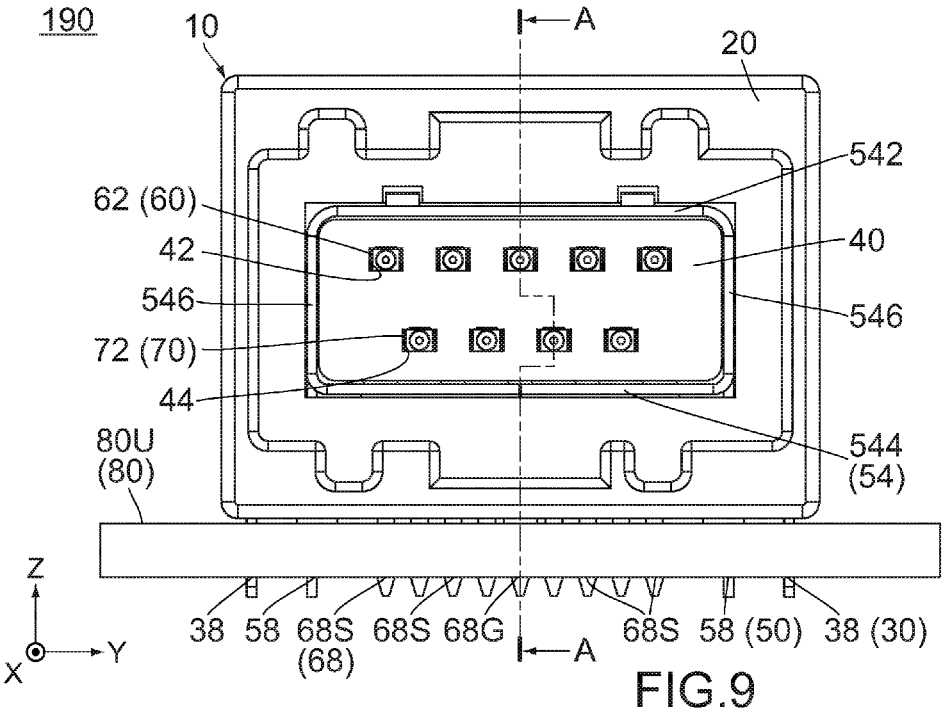
FIG. 9 is a front view showing the connector of FIG. 1 and the circuit board of FIG. 6.
Figure 10:
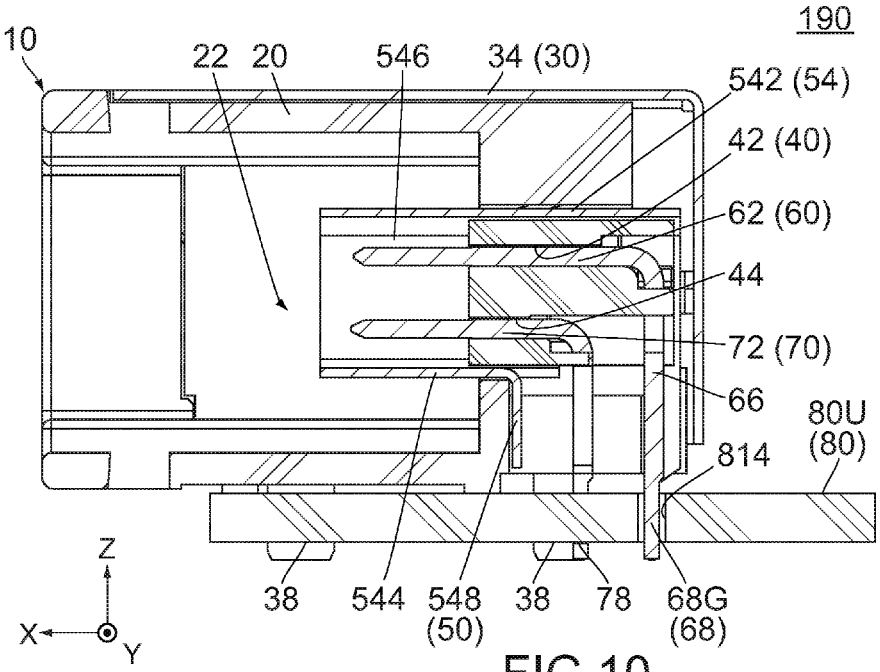
FIG. 10 is a cross-sectional view showing the connector and the circuit board of FIG. 9, taken along line A-A.

Referring to FIGS. 1, 9 and 10, a connector 10 according to an embodiment of the present invention is mounted on an upper surface 80U, or the positive Z-side surface, of a circuit board 80 in an up-down direction (the Z-direction) when the connector 10 is used. The connector 10 mounted on the circuit board 80 forms a connector assembly 190 together with the circuit board 80. In other words, the connector assembly 190 comprises the connector 10 and the circuit board 80. For example, the connector assembly 190 is installed and used in an electronic device (not shown).

Figure 12:
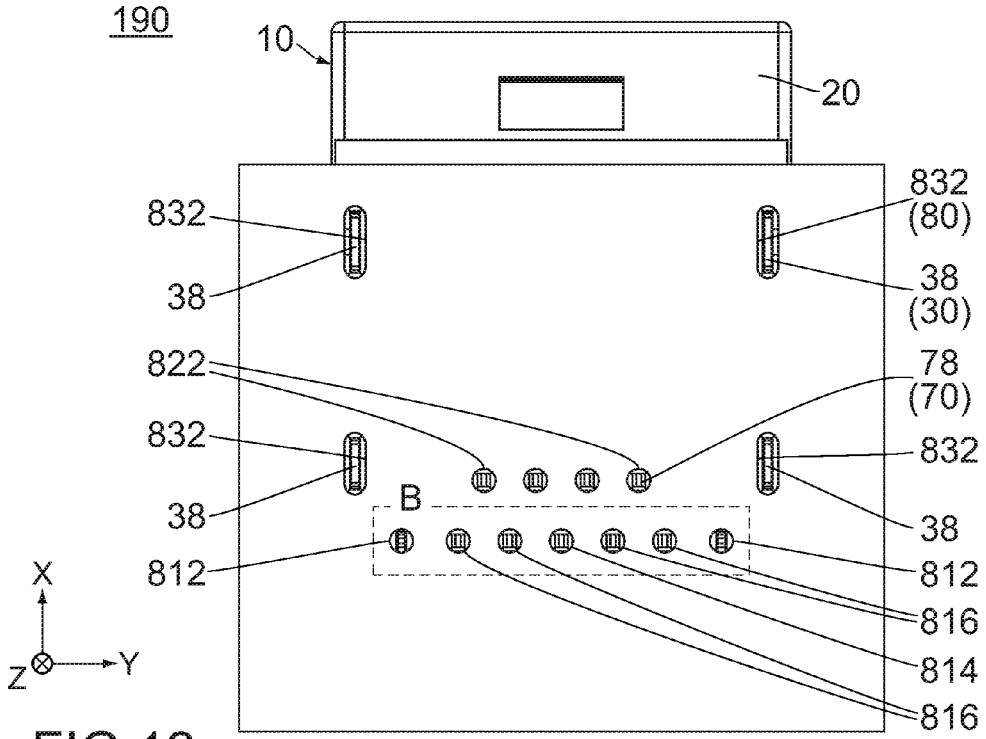
FIG. 12 is a bottom view showing the connector and the circuit board of FIG. 9.

As shown in FIG. 12, the circuit board 80 according to the present embodiment is formed with seven first fixing portions (fixing portions) 812, 814 and 816, four second fixing portions 822 and four third fixing portions 832. Each of the fixing portions 812, 814 and 816, the second fixing portions 822 and the third fixing portions 832 is a through hole for fixing the connector 10. The connector 10 according to the present embodiment is configured to be attached to the thus-formed circuit board 80 by using through-hole technology. However, the present invention is also applicable to a connector which is configured to be attached to the circuit board 80 by using surface mount technology (SMT). In such configuration, each of the fixing portions 812, 814 and 816, the second fixing portions 822 and the third fixing portions 832 is, for example, a conductive pad (not shown) provided on the upper surface 80U of the circuit board 80.

Figure 2:
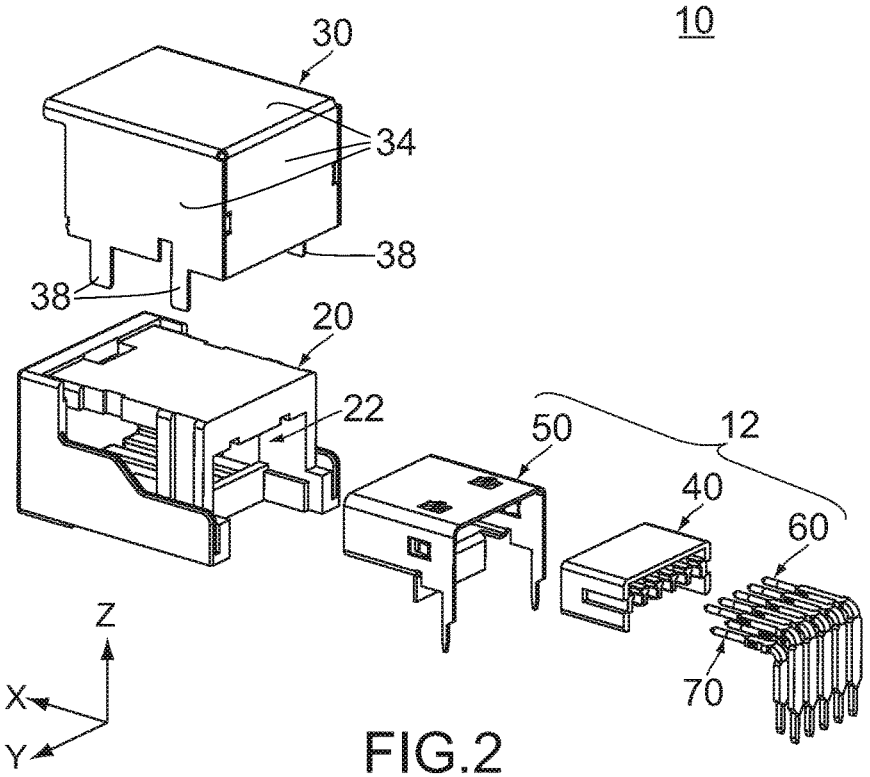
FIG. 2 is an exploded, perspective view showing the connector of FIG. 1.

Referring to FIGS. 1 and 2, the connector 10 according to the present embodiment comprises an outer housing (housing) 20 made of insulator, an outer shell 30 made of metal, an inner housing (holding member) 40 made of insulator, an inner shell (shell) 50 made of metal, five first contacts (contacts) 60 each made of conductor and four second contacts 70 each made of conductor.

Figure 3:
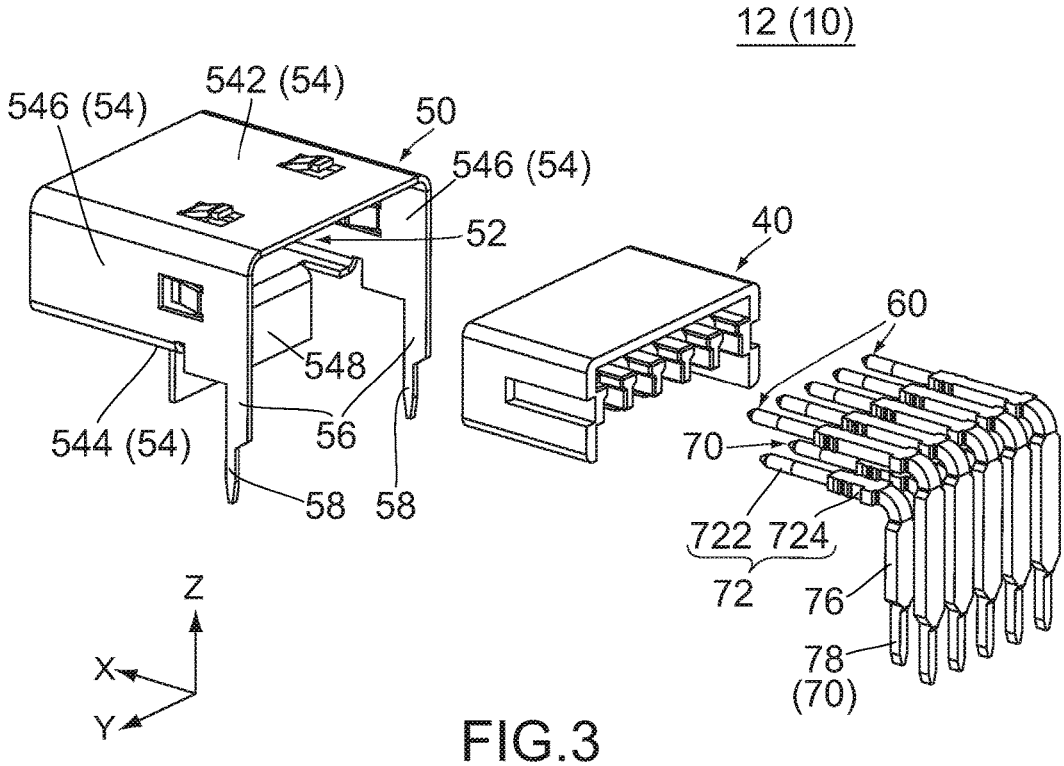
FIG. 3 is an exploded, perspective view showing an inner assembly of the connector of FIG. 2.
Figure 5:
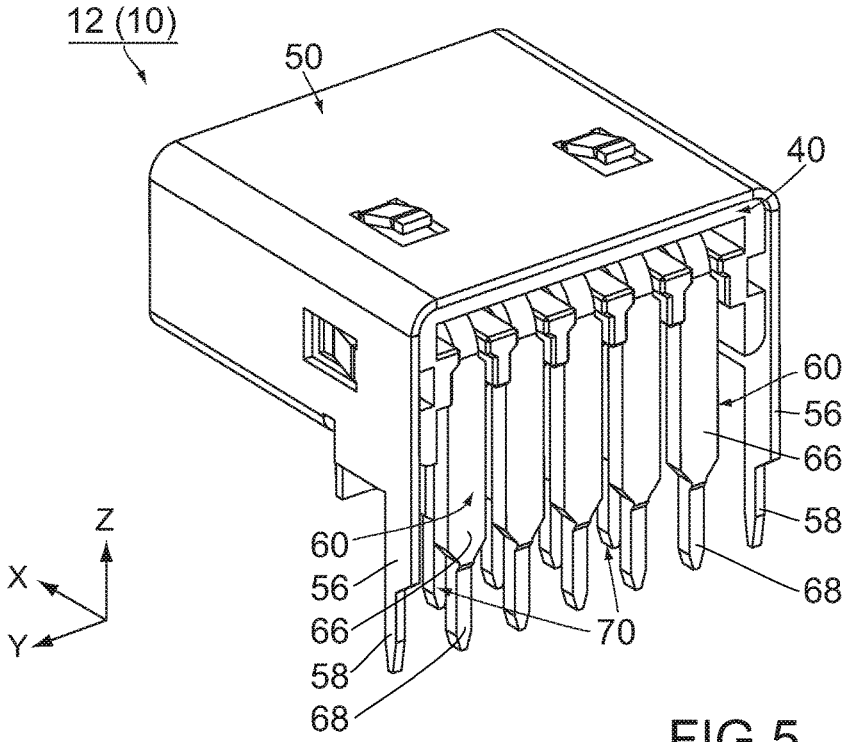
FIG. 5 is a perspective view showing the inner assembly of FIG. 3.

Referring to FIGS. 2, 3 and 5, the holding member 40, the shell 50, the five contacts 60 and the four second contacts 70 form an inner assembly 12. According to the present embodiment, the connector 10 includes the inner assembly 12 as a part thereof. However, the present invention is not limited thereto. For example, the connector 10 may comprise only the inner assembly 12.

Figure 4:
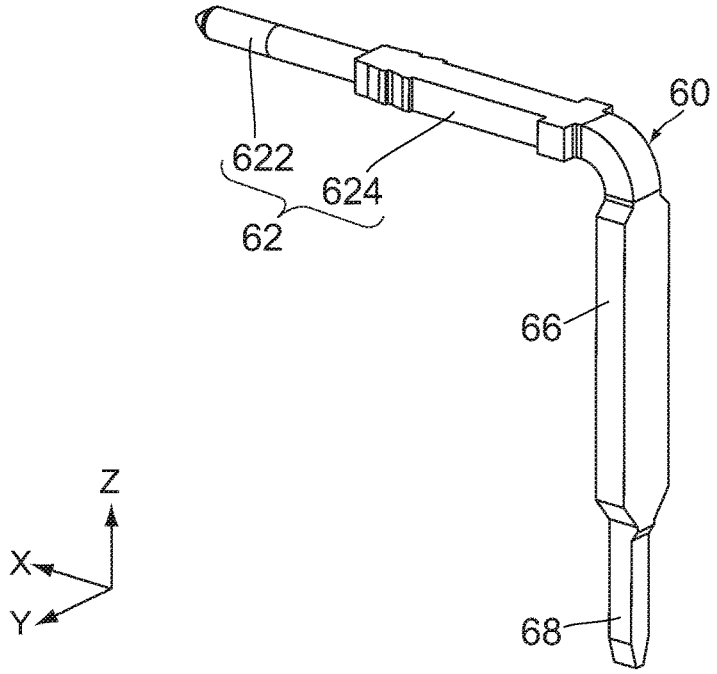
FIG. 4 is a perspective view showing a first contact (contact) of the inner assembly of FIG. 3.

Referring to FIGS. 3 and 4, the five contacts 60 according to the present embodiment have shapes and sizes same as one another. Each of the contacts 60 has a connection portion 62, a coupling portion 66 and a fixed portion 68. The connection portion 62 extends along the X-direction (front-rear direction: mating direction), and the fixed portion 68 extends along the Z-direction. The connection portion 62 has a contact portion 622 and a held portion 624. The contact portion 622 is brought into contact with a mating contact (not shown) when the connector 10 is mated with a mating connector (not shown) along the X-direction.

Figure 7:
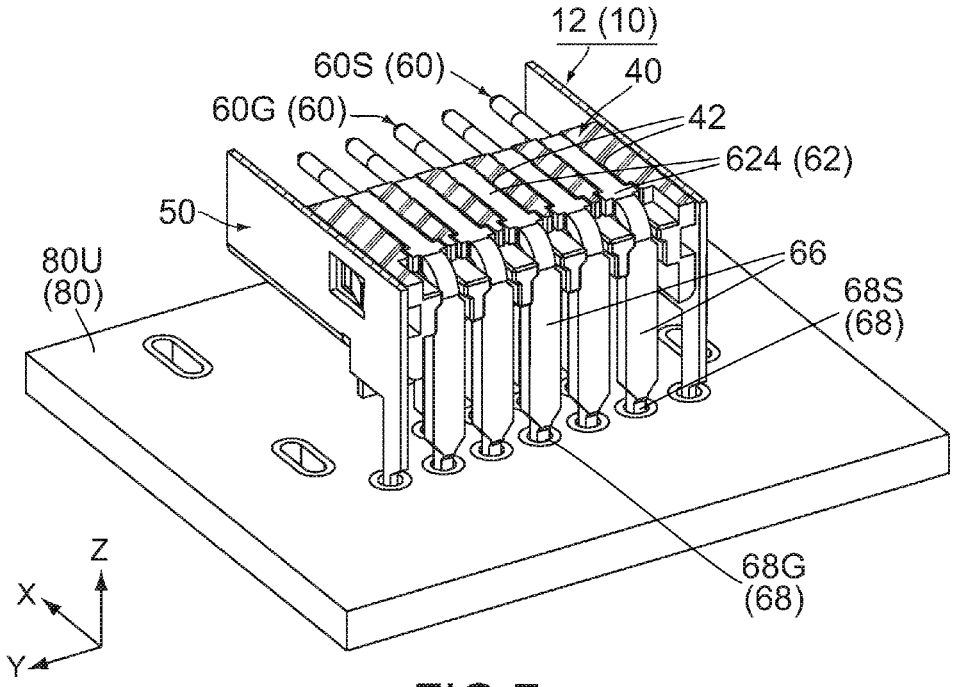
FIG. 7 is a perspective, cross-section view of the inner assembly and the circuit board illustrated in FIG. 6.

Referring to FIG. 7, the connector 10 according to the present embodiment is a right-angle connector. In particular, the coupling portion 66 according to the present embodiment extends in the Z-direction as a whole and couples the connection portion 62 and the fixed portion 68 with each other. However, the present invention is not limited thereto. For example, the coupling portion 66 may be oblique to the connection portion 62. In other words, it is sufficient that the coupling portion 66 extends in a direction intersecting with the connection portion 62 and couples the connection portion 62 and the fixed portion 68 with each other. Moreover, the connector 10 according to another embodiment may be a straight connector. In such embodiment, the connector 10 mounted on the upper surface 80U of the circuit board 80 is mateable with a mating connector (not shown) along the Z-direction. The connection portion 62 according to this embodiment may extend along the Z-direction (up-down direction: mating direction) similar to the fixed portion 68.

Figure 6:
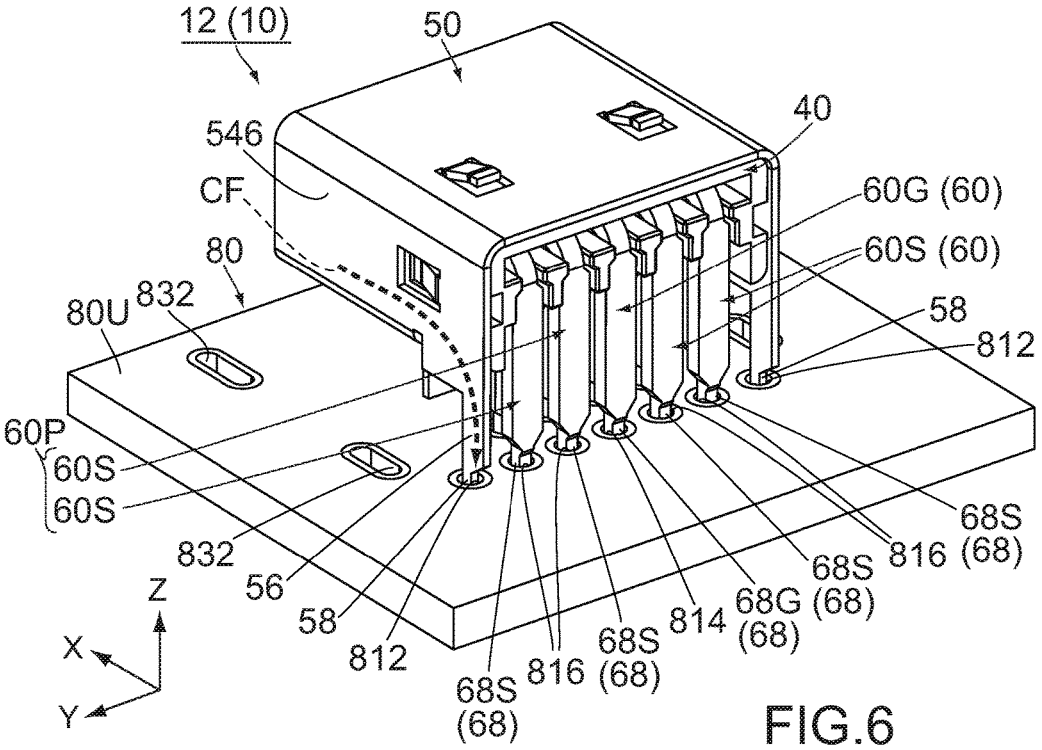
FIG. 6 is a perspective view showing the inner assembly of FIG. 5 and a circuit board, wherein dashed line illustrates a current path flowing from an inner shell (shell) of the inner assembly toward the circuit board.
Figure 8:
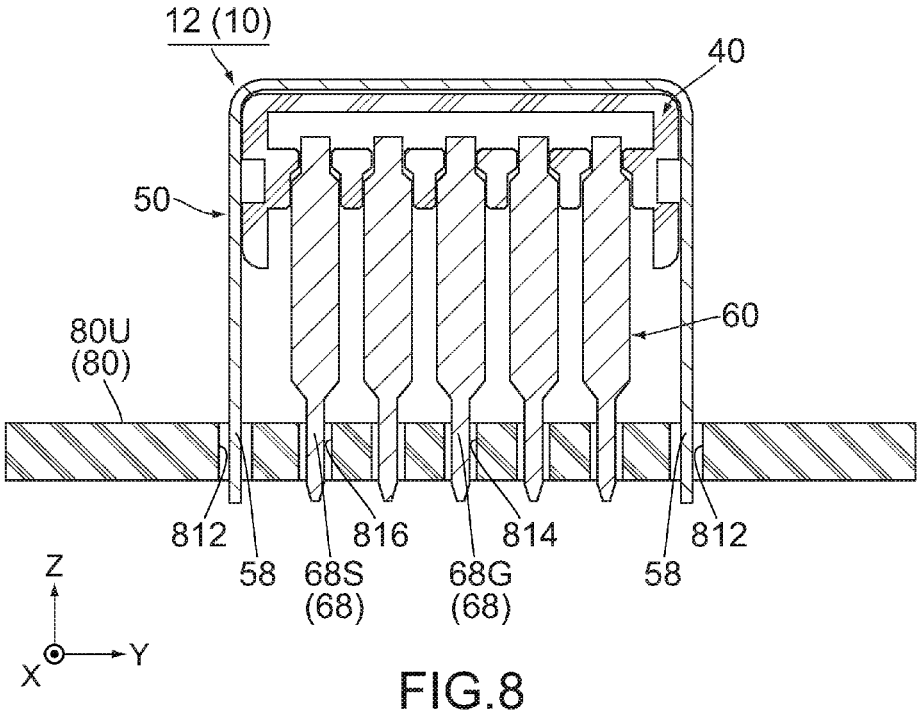
FIG. 8 is a cross-sectional view showing the inner assembly and the circuit board of FIG. 6.

As can be seen from FIGS. 6 and 8, when the connector 10 is used, each of the fixed portions 68 is fixed to and electrically connected with the corresponding fixing portion 814 or the corresponding fixing portion 816 of the circuit board 80 via soldering, etc. The fixed portion 68 according to the present embodiment is a predetermined part of the contact 60, wherein the predetermined part is inserted inside of the fixing portion 814 or the fixing portion 816 when the connector 10 is used. However, the present invention is not limited thereto. In the embodiment where the connector 10 is configured to be attached to the circuit board 80 by using SMT, the fixed portion 68 may be fixed to the conductive pad (not shown) on the upper surface 80U of the circuit board 80. In this embodiment, the fixed portion 68 may extend along the X-direction.

Referring to FIG. 3, the four second contacts 70 according to the present embodiment have shapes and sizes same as one another. The second contact 70 has a structure similar to that of the contact 60. In detail, each of the second contacts 70 has a connection portion 72, a coupling portion 76 and a fixed portion 78. The connection portion 72 extends along the X-direction, and the fixed portion 78 extends along the Z-direction. The coupling portion 76 extends along the Z-direction as a whole and couples the connection portion 72 and the fixed portion 78 with each other. The connection portion 72 has a contact portion 722 and a held portion 724. When the connector 10 is mated with the mating connector (not shown), the contact portion 722 is brought into contact with a mating contact (not shown). Referring to FIG. 12, when the connector 10 is used, each of the fixed portions 78 is fixed to and electrically connected with the corresponding second fixing portion 822 of the circuit board 80 via soldering, etc.

Referring to FIGS. 7, 9 and 10, the holding member 40 has five first holding portions 42 and four second holding portions 44. Referring together with FIG. 3, the contacts 60 are press-fit into the first holding portions 42, respectively, from a rear side, or the negative X-side, of the holding member 40 and held by the first holding portions 42, respectively. The contacts 60 held by the holding member 40 are arranged in a row in a pitch direction (the Y-direction). Similarly, the second contacts 70 are press-fit into the second holding portions 44, respectively, from the rear side of the holding member 40 and held by the second holding portions 44, respectively. The second contacts 70 held by the holding member 40 are arranged in another row in the Y-direction.

Referring to FIG. 3, the shell 50 according to the present embodiment is formed by bending a single metal plate. In other words, the shell 50 is a unitary metal piece which is bent. The shell 50 has a body 54, a middle plate 548, two coupling portions 56 and two shell fixed portions 58. The body 54 has an upper plate 542, a bottom plate 544 and two side plates 546 which are formed into a square cylindrical shape, so that the shell 50 is formed with an accommodation portion 52 covered by the body 54. The middle plate 548 extends downward, or in the negative Z-direction, from a rear end, or from the negative X-side end, of the bottom plate 544. The coupling portions 56 extend downward from rear ends of the side plates 546, respectively. The shell fixed portions 58 extend downward from lower ends, or the negative Z-side ends, of the coupling portions 56, respectively.

As can be seen from FIGS. 6 and 8, when the connector 10 is used, each of the shell fixed portions 58 is fixed to and electrically connected with the corresponding fixing portion 812 of the circuit board 80 via soldering, etc. Each of the shell fixed portions 58 according to the present embodiment is a predetermined part of the shell 50, wherein the predetermined part is inserted inside of the fixing portion 812 when the connector 10 is used. However, in the embodiment where the connector 10 is configured to be attached to the circuit board 80 by using SMT, the shell fixed portion 58 may be fixed to the conductive pad (not shown) on the upper surface 80U of the circuit board 80. In this embodiment, the shell fixed portion 58 may extend along the X-direction or the Y-direction. Moreover, although each of the shell fixed portions 58 according to the present embodiment is integrally formed with the shell 50, the present invention is not limited thereto. The shell fixed portion 58 may be a member other than the shell 50, or may be formed separately from the shell 50, provided that the shell fixed portion 58 is connected to the shell 50.

Referring to FIGS. 3 and 5, the holding member 40, which holds the contacts 60 and the second contacts 70, is inserted into the accommodation portion 52 of the shell 50 from a rear side of the shell 50 and accommodated in the accommodation portion 52, so that the inner assembly 12 is formed. Referring to FIG. 10, in the inner assembly 12, the body 54 and the middle plate 548 of the shell 50 cover and electromagnetically shield the contacts 60 and the second contacts 70.

As shown in FIGS. 1, 2 and 10, the housing 20 is formed with a receiving portion 22 for receiving a fit portion (not shown) of the mating connector (not shown). The receiving portion 22 is a space which passes through the housing 20 along the X-direction. The inner assembly 12 is inserted into the receiving portion 22 from a rear side of the housing 20.

Referring to FIGS. 1 and 2, the outer shell 30 has a body 34 and four legs 38. The body 34 is attached to the housing 20 from above, or from the positive Z-side of the housing 20. The body 34 covers and electromagnetically shields four sides, namely, an upper side, a rear side and opposite lateral sides, of the inner assembly 12 inserted in the receiving portion 22. The shell 50 is connected to a spring portion (not shown) of the outer shell 30 at a rear end of the outer shell 30. This connection makes an electric potential of the shell 50 equal to another electric potential of the outer shell 30. The legs 38 extend downward from the body 34. Referring to FIG. 12, when the connector 10 is used, a lower end of each of the legs 38 is fixed to and electrically connected with the corresponding third fixing portion 832 of the circuit board 80 via soldering, etc.

Referring to FIGS. 6 to 8, the contacts 60 of the connector 10 having the aforementioned structure can be used for USB 3.0 connection. In this usage, the contact 60 located at the middle of the five contacts 60 in the Y-direction works as a ground contact 60G that transmits a ground signal. Each of the four contacts 60 other than the ground contact 60G works as a signal contact 60S that transmits a data signal. Moreover, two of the signal contacts 60S located toward the positive Y-side of the ground contact 60G form a differential pair 60P for high-speed signal transmission, or a pair of contacts for differential transmission. Similarly, two of the signal contacts 60S located toward the negative Y-side of the ground contact 60G form another differential pair 60P.

As previously described, the five contacts 60 have the same shape and size as one another. Accordingly, the two signal contacts 60S of each of the differential pairs 60P have the same shape and size as each other. Moreover, the ground contact 60G has the same shape and size as the signal contact 60S. However, the ground contact 60G may have a size or a shape different from that of the signal contact 60S. Moreover, provided that the two signal contacts 60S of the differential pair 60P have shapes and sizes roughly same as each other, the two signal contacts 60S of the differential pair 60P may have the respective additional portions such as press-fit protrusions different from each other, and the additional portion of one of the signal contacts 60S may be provided at a position different from that of the additional portion of a remaining one of the signal contacts 60S.

The connector 10 comprises the shell 50, the two shell fixed portions 58, the one ground contact 60G and the two differential pairs 60P, wherein these members and portions are particularly related to the USB 3.0 connection. The ground contact 60G has the connection portion 62, the coupling portion 66 and a ground fixed portion 68G that is the fixed portion 68. Each of the differential pairs 60P consists of the two signal contacts 60S. In other words, each of the differential pairs 60P includes only two of the signal contacts 60S. Each of the signal contacts 60S has the connection portion 62, the coupling portion 66 and a signal fixed portion 68S that is the fixed portion 68. Hereafter, explanation will be made in further detail about structures and functions of these members and portions.

Referring to FIGS. 6 and 8, when the connector 10 is used, the shell fixed portions 58, the ground fixed portion 68G and the signal fixed portions 68S are fixed to the fixing portions 812, 814 and 816 of the circuit board 80, respectively, via soldering, press-fitting, etc. As a result of the soldering, each of the fixing portions 812, 814 and 816 is filled with solder (i.e. conductor). As another result of the press-fitting, the shell fixed portions 58, the ground fixed portion 68G and the signal fixed portions 68S of the connector 10 are brought into contact with the respective conductors (not shown) which form inner walls of the fixing portions 812, 814 and 816, respectively.

Figure 13:
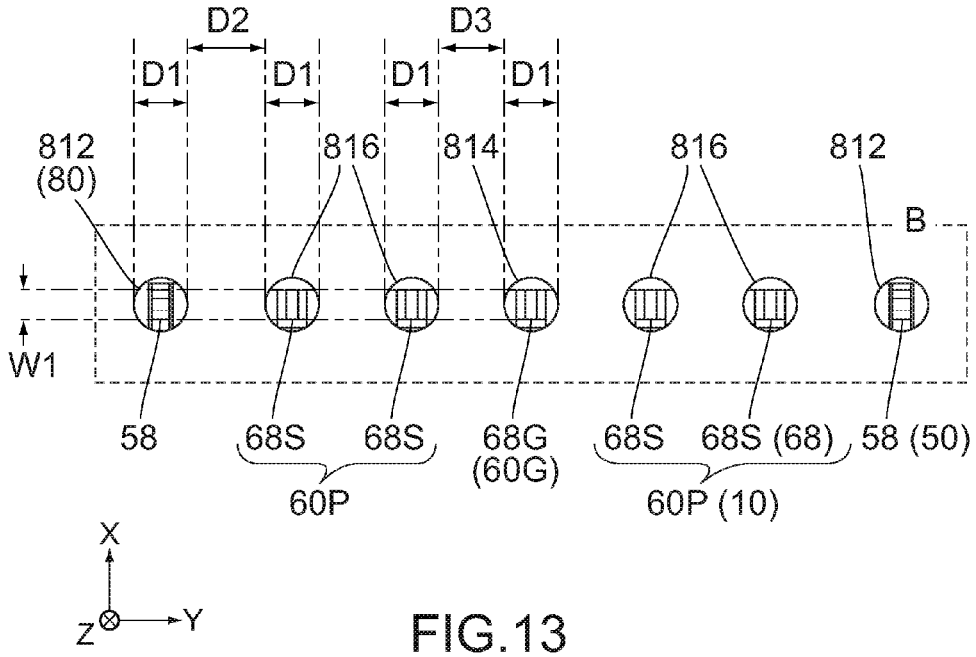
FIG. 13 is a bottom view showing the part enclosed by dashed line B of FIG. 12, wherein the enclosed part includes a part of the connector and a part of the circuit board each of which is located in the vicinity of fixing portions of the circuit board.
Figure 14:
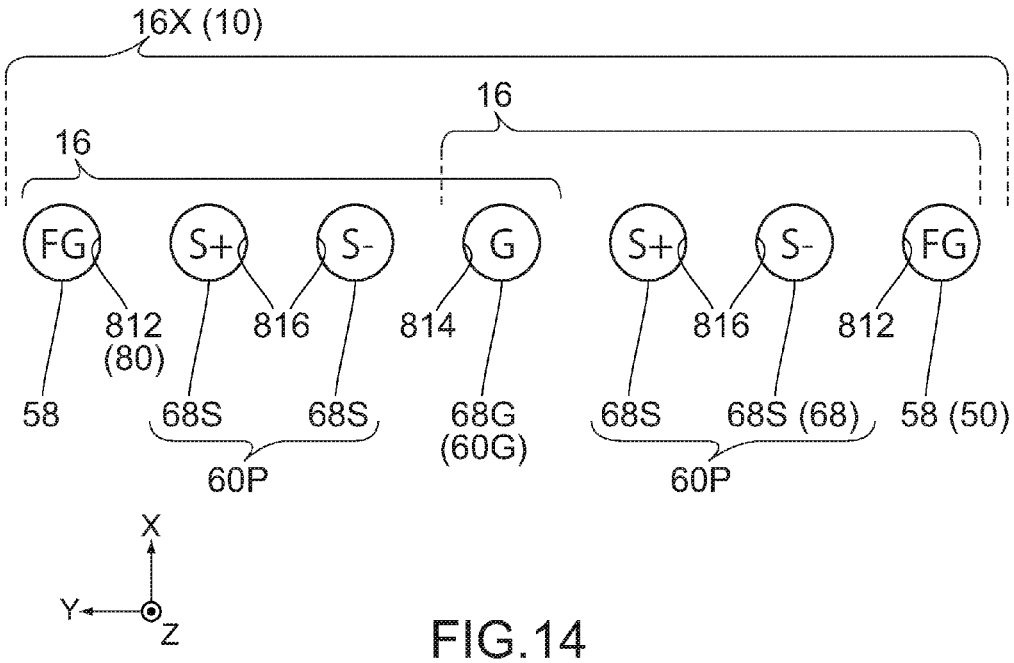
FIG. 14 is a plan view schematically showing an arrangement of shell fixed portions, a ground fixed portion and signal fixed portions of the connector of FIG. 13.

Referring to FIGS. 13 and 14, in the present embodiment, all of the portions fixed to the circuit board 80, namely, the two shell fixed portions 58, the one ground fixed portion 68G and the four signal fixed portions 68S, are adjacent to one another in the Y-direction to form one fixed-portion group 16X. In the fixed-portion group 16X, all of the shell fixed portions 58, the signal fixed portions 68S and the ground fixed portion 68G are arranged in a row, in particular, on a straight line, along the Y-direction.

In detail, the two signal fixed portions 68S of the positive Y-side differential pair 60P form one outside group (fixed-portion group) 16 together with the shell fixed portion 58 and the ground fixed portion 68G which interpose this two signal fixed portions 68S therebetween in the Y-direction. Similarly, the two signal fixed portions 68S of the negative Y-side differential pair 60P form another fixed-portion group 16 together with the shell fixed portion 58 and the ground fixed portion 68G which interpose this two signal fixed portions 68S therebetween in the Y-direction. The whole of the two fixed-portion groups 16 are included in the fixed-portion group 16X and arranged on an imaginary straight line which extends along the Y-direction. The two fixed-portion groups 16 according to the present embodiment include the same ground fixed portion 68G in common. Moreover, each of the shell fixed portions 58, the signal fixed portions 68S and the ground fixed portion 68G is included in any one of the fixed-portion groups 16.

As described above, the shell fixed portions 58, the ground fixed portion 68G and the signal fixed portions 68S form one or more of the fixed-portion groups 16. Each of the fixed-portion groups 16 consists of one of the shell fixed portions 58, the one ground fixed portion 68G and the two signal fixed portions 68S of one of the differential pairs 60P. In other words, each of the fixed-portion groups 16 includes only four portions, namely, one of the shell fixed portions 58, the one ground fixed portion 68G and the two signal fixed portions 68S of one of the differential pairs 60P. Moreover, in each of the fixed-portion groups 16, the shell fixed portion 58 is adjacent to one of the signal fixed portions 68S (the outside signal fixed portion 68S that is located outside in the Y-direction), the one of the signal fixed portions 68S is adjacent to a remaining one of the signal fixed portions 68S (the inside signal fixed portion 68S that is located inside in the Y-direction), and the remaining one of the signal fixed portions 68S is adjacent to the ground fixed portion 68G. No conductor is provided between the shell fixed portion 58 and the outside signal fixed portion 68S that is located outside in the Y-direction. Similarly, no conductor is provided between the one ground fixed portion 68G and the inside signal fixed portion 68S that is located inside in the Y-direction.

According to the present embodiment, in each of the fixed-portion groups 16, the shell fixed portion 58, the two signal fixed portions 68S and the ground fixed portion 68G are arranged in a row along the Y-direction. When the connector 10 is used, each of the signal fixed portions 68S is connected to one of the fixing portions 816, or one of a signal end (S+) and a signal end (S−), of the circuit board 80. In addition, the shell fixed portion 58 is grounded to the fixing portion 812, or a frame ground (FG), of the circuit board 80, and the ground fixed portion 68G is grounded to the fixing portion 814, or a signal ground (G), of the circuit board 80.

Because of the aforementioned structure, when the connector 10 is used, the two signal ends (S+) and (S−) are electromagnetically coupled with the two grounds (FG) and (G), respectively, in a similar manner to each other. Accordingly, in each of the fixed-portion groups 16, a differential impedance between the outside signal fixed portion 68S that is located outside in the Y-direction and the shell fixed portion 58 can be balanced with another differential impedance between the inside signal fixed portion 68S that is located inside in the Y-direction and the ground fixed portion 68G. In other words, the differential impedances can be well-balanced. As a result, transmission performance of the signal contacts 60S of the differential pair 60P can be prevented from being degraded.

Referring to FIG. 13, in the X-direction, the size (W1) of the shell fixed portion 58, the size (W1) of the ground fixed portion 68G and the size (W1) of the signal fixed portion 68S are same as one another. Accordingly, the fixing portions 812, 814 and 816 can be formed to have sizes same as one another in a horizontal plane (the XY-plane) perpendicular to the Z-direction. In detail, the fixing portions 812, 814 and 816 have the same diameter (D1) as one another. The differential impedances can be further well-balanced by this structure. However, the present invention is not limited thereto. For example, in a case where the connector 10 is an SMT connector, the fixing portions 812, 814 and 816, each of which is the conductive pad (not shown), may have sizes same as one another in the X-direction. In other words, regardless of whether each of the fixing portions 812, 814 and 816 is the through hole or the conductive pad, it is sufficient that the sizes of the fixing portions 812, 814 and 816 in the X-direction are same as one another.

Referring to FIGS. 13 and 14, in the present embodiment, a distance (D2) is slightly larger than another distance (D3), wherein D2 is a distance along the Y-direction between an inner edge the fixing portion 812 (FG) and an outer edge of the outside fixing portion 816 (S+ or S−) that is located outside in the Y-direction, and D3 is a distance along the Y-direction between an outer edge of the fixing portions 814 (G) and an inner edge of the inside fixing portion 816 (S− or S+) that is located inside in the Y-direction. In a view point of well-balancing between the differential impedances, D2 and D3 are preferred to be equal to each other. However, sufficient effect can be obtained, for example, when D2 is not smaller than D3×0.8 but is not larger than D3×1.2.

Figure 11:
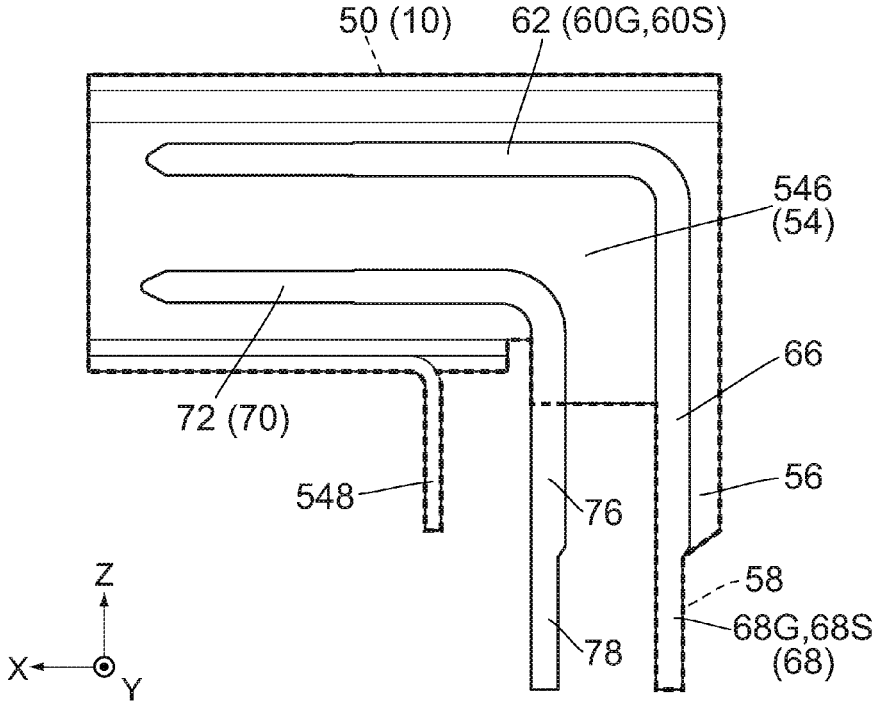
FIG. 11 is a side view showing an outline of the shell, an outline of the contact and an outline of a second contact of the connector of FIG. 10, wherein the outline of the shell is illustrated by dashed line.

Referring to FIG. 6, the shell 50 is grounded to the circuit board 80 via the coupling portions 56 connected to the side plates 546 and via the shell fixed portions 58 connected to the coupling portions 56 (see a current path CF illustrated by dashed line). Referring to FIGS. 10 and 11, each of the side plates 546 of the shell 50 is located outward of both the ground contact 60G and the signal contacts 60S in the Y-direction and covers the most of the ground contact 60G and the signal contact 60S from outside in the Y-direction. In detail, when each of the side plates 546 is seen along the Y-direction, the side plate 546 occupies an area same as the whole of the connection portion 62 and an upper part, or the positive Z-side part, of the coupling portion 66. In addition, when each of the coupling portions 56 of the shell 50 is seen along the Y-direction, the coupling portion 56 occupies an area same as a lower part, or the negative Z-side part, of the coupling portion 66 of each of the ground contact 60G and the signal contact 60S.

In other words, the side plate 546 and the coupling portion 56 of the shell 50 occupy a predetermined area in the XZ-plane, wherein this predetermined area is also occupied by the connection portion 62 and the coupling portion 66 of the signal contact 60S that is arranged in the differential pair 60P to be located outside in the Y-direction. In addition, the connection portion 62 and the coupling portion 66 of the ground contact 60G occupy another predetermined area in the XZ-plane, wherein this predetermined area is also occupied by the connection portion 62 and the coupling portion 66 of the signal contact 60S that is arranged in the differential pair 60P to be located inside in the Y-direction. The differential impedances can be further well-balanced by this structure.

However, the present invention is not limited thereto. For example, the connection portion 62 and the coupling portion 66 may be completely covered only by the side plates 546 from outside in the Y-direction. For another example, a part of or the whole of the coupling portion 66 does not need to be covered from outside in the Y-direction. In other words, when the shell 50 and the coupling portion 66 are seen along the Y-direction, a part of the shell 50 may occupy an area same as at least a part of the coupling portion 66.

As explained below, the present embodiment can be further variously modified in addition to the already described modifications.

Referring to FIG. 6, in the present embodiment, the number of the ground contact 60G is one, the number of the differential pairs 60P is two, and the number of the shell fixed portions 58 is two. However, the number of the ground contacts 60G may be one or more, and the number of the differential pairs 60P may be one or more. Accordingly, the number of the contacts 60 does not need to be five. Moreover, the number of the shell fixed portions 58 may be one or more. The circuit board 80 may be formed with two or more of the fixing portions 812, 814 and 816 which correspond to the shell fixed portions 58, the ground fixed portions 68G and the signal fixed portions 68S of the connector 10, respectively.

Figure 15:
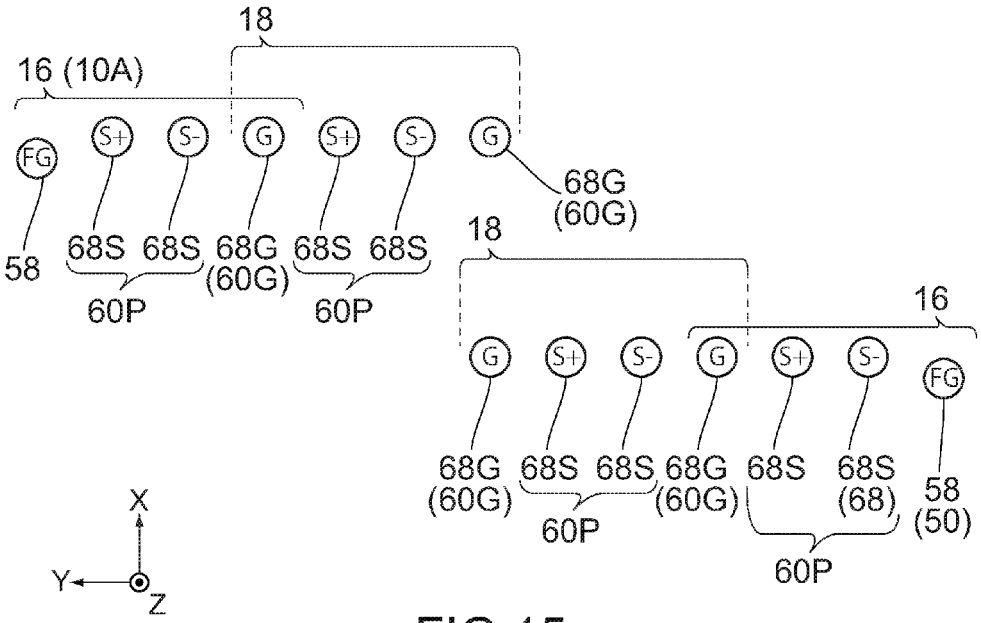
FIG. 15 is a plan view showing a modification of the arrangement of FIG. 14.
Figure 16:
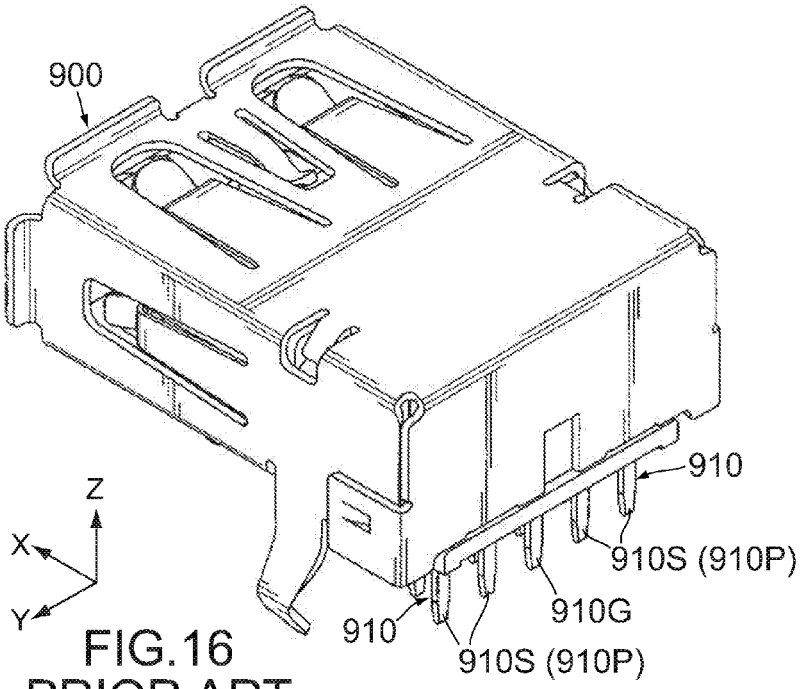
FIG.16 PRIOR ART
FIG. 16 is a perspective view showing a connector of Patent Document 1.

Referring to FIG. 15, a connector 10A according to a modification comprises the two shell fixed portions 58, the four ground contacts 60G and the four differential pairs 60P. Moreover, the connector 10A is formed with two inside groups 18 in addition to the two fixed-portion groups 16, wherein each of the inside groups 18 has a formation different from that of the fixed-portion group 16. Each of the inside groups 18 includes one of the ground fixed portions 68G instead of the shell fixed portion 58. Thus, in each of the inside groups 18, the two signal fixed portions 68S are located between the two ground fixed portions 68G.

As can be seen from the structure of the connector 10A, there may be the signal fixed portion 68S that is not included in any of the fixed-portion groups 16, provided that the connector 10A includes some grounded portions and provided that the two signal fixed portions 68S of each of the differential pair 60P can be electromagnetically coupled with the respective grounded portions. Moreover, the position of the shell fixed portion 58 in the X-direction may be different from the position of the ground fixed portion 68G or the signal fixed portion 68S in the X-direction to some extent, provided that the ground fixed portion 68G and the two signal fixed portions 68S in each of the fixed-portion groups 16 are arranged in a row along the Y-direction. In other words, it is sufficient that when each of the fixed-portion groups 16 is seen along the Y-direction, at least a part of the shell fixed portion 58 occupies an area same as a part of the signal fixed portion 68S.

Referring to FIG. 6, the contacts 60 can be used for purpose other than USB 3.0 connection. Regardless of the usage of the contacts 60, the connector 10 generally comprises N+2 of the contacts 60, where N is an integer of 1 or more. The two shell fixed portions 58 and the N+2 fixed portions 68 are adjacent to one another in the Y-direction to form the one fixed-portion group 16X (see FIG. 14). In the fixed-portion group 16X, the fixed portions 68 are arranged in a row along the Y-direction, and the shell fixed portions 58 are located at opposite ends of the fixed-portion group 16X in the Y-direction, respectively. When the thus-arranged fixed-portion group 16X is seen along the Y-direction, at least a part of each of the shell fixed portions 58 occupies an area same as a part of the fixed portion 68.

The present invention is not limited to the already described embodiment and modifications but further variously applicable. For example, the present invention is applicable not only to a receptacle and a plug compliant with the USB 3.0 standard but also to another receptacle and another plug.

The present application is based on a Japanese patent application of JP2015-139827 filed before the Japan Patent Office on Jul. 13, 2015, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a circuit board formed with fixing portions; and a connector mountable on the circuit board in an up-down direction, the connector comprising a holding member, a shell, one or more of shell fixed portions, one or more of ground contacts and one or more of differential pairs, wherein:

each of the shell fixed portions is connected to the shell and is fixed to a corresponding one of the fixing portions of the circuit board;

each of the ground contacts has a connection portion held by the housing and a ground fixed portion which is fixed to a corresponding one of the fixing portions of the circuit board;

each of the differential pairs consists of two signal contacts;

each of the signal contacts has a connection portion held by the housing and a signal fixed portion which is fixed to a corresponding one of the fixing portions of the circuit board;

the connection portions of the ground contacts and the connection portions of the signal contacts are arranged in a row in a pitch direction perpendicular to the up-down direction;

the connection portions of the two signal contacts of each of the differential pairs are adjacent to each other with no part of any of the ground contacts therebetween in the pitch direction;

the shell fixed portions, the ground fixed portions and the signal fixed portions form one or more of fixed-portion groups;

each of the fixed-portion groups consists of one of the shell fixed portions, one of the ground fixed portions and the two signal fixed portions of one of the differential pairs;

in each of the fixed-portion groups, the shell fixed portion, an outside signal fixed portion and an inside signal fixed portion of the two signal fixed portions, and the ground fixed portion are arranged in a row along the pitch direction;

in each of the fixed-portion groups, a distance D2 is not smaller than a distance D3 ×0.8 and is not larger than the distance D3 ×1.2, wherein the distance D2 is a distance along the pitch direction between an inner edge of the fixing portion fixed to the shell fixed portion and an outer edge of the fixing portion fixed to the outside signal fixed portion, which is adjacent to the shell fixed portion, and the distance D3 is a distance along the pitch direction between an outer edge of the fixing portion fixed to the ground fixed portion and an inner edge of the fixing portion fixed to the inside signal fixed portion, which is adjacent to the ground fixed portion; and when each of the fixed-portion groups is seen along the pitch direction, at least a part of the shell fixed portion occupies an area same as a part of the outside signal fixed portion.

2. The connector assembly as recited in claim 1, wherein each of the shell fixed portions is integrally formed with the shell.

3. The connector assembly as recited in claim 1, wherein all of the fixed-portion groups are arranged on a straight line which extends along the pitch direction.

4. The connector assembly as recited in claim 1, wherein:

the number of the ground contacts is one; and the number of the differential pairs is two.

5. The connector assembly as recited in claim 1, wherein:

the shell has a side plate which is located outward of both the ground contacts and the signal contacts in the pitch direction; and when the side plate is seen along the pitch direction, a part of the side plate occupies an area same as parts of the ground contacts and the signal contacts.

6. The connector assembly as recited in claim 1, wherein the shell fixed portions, the ground fixed portions and the signal fixed portions have sizes same as one another in a direction perpendicular to both the pitch direction and the up-down direction.

7. The connector assembly as recited in claim 1, wherein:

each of the signal contacts has a coupling portion;

the connection portion of the signal contact extends along a direction perpendicular to both the pitch direction and the up-down direction;

the coupling portion extends in another direction intersecting with the connection portion and couples the connection portion of the signal contact and the signal fixed portion with each other; and when the shell and the coupling portion are seen along the pitch direction, a part of the shell occupies an area same as a part of the coupling portion.

8. The connector assembly as recited in claim 1, wherein the fixing portions have sizes same as one another in a direction perpendicular to both the pitch direction and the up-down direction.

9. The connector assembly as recited in claim 8, wherein:

each of the fixing portions is a through hole; and the fixing portions have sizes same as one another in a plane perpendicular to the up-down direction.

* * * * *